US005499763A

United States Patent [19]

DeMars

[11] Patent Number: 5,499,763

[45] Date of Patent: Mar. 19, 1996

[54] COLLAPSIBLE CONTAINER

[76] Inventor: Robert A. DeMars, 5000 N. Parkway Calabasas, Ste. 233, Calabasas, Calif. 91302

[21] Appl. No.: 430,507

[22] Filed: Apr. 25, 1995

[51] Int. Cl.[6] ..... B65D 3/06; B65D 3/24

[52] U.S. Cl. ..... 229/114; 229/4.5; 229/400

[58] Field of Search ..... 229/4.5, 116.1, 229/400, 405, 114; 220/505, 527, 574, 575; 426/115, 120

[56] References Cited

U.S. PATENT DOCUMENTS

| | | | |
|---|---|---|---|
| 1,127,480 | 2/1915 | Maxwell | 229/405 |
| 1,450,832 | 4/1923 | Barbieri | 229/400 |
| 2,210,566 | 8/1940 | Bockman | 229/4.5 |
| 2,352,393 | 6/1944 | Lee | 229/114 |
| 2,552,051 | 5/1951 | Margulies | 229/400 |
| 2,749,010 | 6/1956 | Amberg et al. | 229/400 |
| 2,863,366 | 12/1958 | Aldington | 229/400 |
| 3,683,938 | 8/1972 | Rowland | 229/400 |
| 4,307,835 | 12/1981 | Roccaforte | 426/120 |
| 4,586,649 | 5/1986 | Webinger | 229/114 |

*Primary Examiner*—Gary E. Elkins
*Attorney, Agent, or Firm*—Jack C. Munro

[57] ABSTRACT

A collapsible container in the form of a thin sheet material body which is capable of being collapsed by being folded upon itself. When unfolded the body assumes a cone shaped or pyramid shaped chamber. Incorporated within the body is a center section which can be deflected into a cone shape or pyramid shape which is oppositely oriented to the cone shape or pyramid shape of the chamber. The deflected center section will function to retain the container in its expanded position thereby permitting the chamber to be used for small foodstuff particles such as pretzels, potato chips, popcorn and the like. There is a further embodiment which does not require deflection but is constructed of multiple parts that are assembled in a similar cone shape or pyramid shape configuration to form two separate chambers.

2 Claims, 3 Drawing Sheets

COLLAPSIBLE CONTAINER

BACKGROUND OF THE INVENTION

1) Field of the Invention

The field of this invention is directed to containers such as a bowl which is designed to be used in conjunction with serving small, food, particle foodstuff such as potato chips, pretzels, popcorn and the like.

2) Description of the Prior Art

It is common to use a bowl when serving dry, particle foodstuff such as potato chips, popcorn, and pretzels. Potato chips, pretzels and popcorn are commonly sold in flexible walled bags. It is common for a user to tear open such a bag and deposit the contents thereof within a plastic, glass or ceramic bowl in order to serve the contents. However, such rigid walled bowls are not always available in certain environments, such as at a picnic, on the beach or in the automobile. It is common to serve potato chips, popcorn and pretzels directly from the bag. However, such serving is not convenient when a plurality of people are being served.

SUMMARY OF THE INVENTION

The primary objective of the present invention is to construct a container of thin sheet material that can be collapsed and sold within a package of dry particle foodstuff such as potato chips, popcorn, pretzels and the like, with the container in collapsed state occupying a minor amount of the volume of the bag.

Another objective of the present invention is to construct a collapsible container for a bag of foodstuff which can be manufactured and inserted with the product package quite inexpensively and therefore negligibly affect the overall cost of the foodstuff.

Another objective of the present invention is to make a serving container available within every bag of foodstuff so such can optionally be used by the user.

Another objective of the present invention is to provide a container which can include advertising indicia.

The container of the present invention is to be normally constructed of thin sheet material such as paper. The basic shape of the container is that of a cone or pyramid. The container can be collapsed upon itself and folded and then be inserted within a bag of foodstuff. When an individual wishes to serve the foodstuff, the user can extract the collapsed container from the bag, unfold the container to form its expanded bowl-shaped configuration, and then, by deflecting inwardly the center section of the bowl which is oppositely oriented to the basic shape of the container, the container will be formed to its full an expanded position thus having sufficient sidewall strength to function as a container for the dry small particle foodstuff. The inverted center creates a base upon which the container can rest.

DETAILED DESCRIPTION OF THE PREFERRED EMBODIMENT

Figure 1:
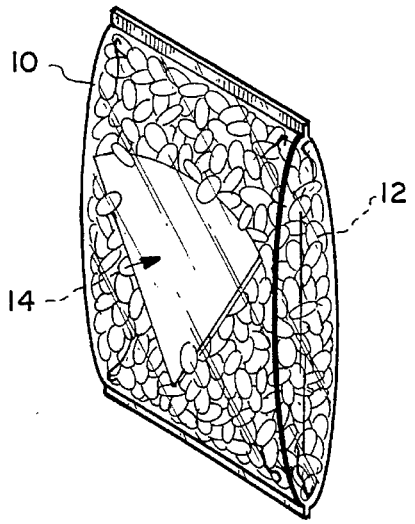
FIG. 1 is an isometric view of a conventional bag of foodstuff for small dry particles such as potato chips, popcorn and the like within which is located a first embodiment collapsible container of the present invention shown in the collapsed configuration.

Referring particularly to the drawing there is shown a foodstuff bag 10 that happens to be substantially transparent that has contained therein a quantity of foodstuff such as potato chips, popcorn or peanuts 12. Contained within the bag 10 is the first embodiment of collapsible container 14 of the present invention.

Figure 6:
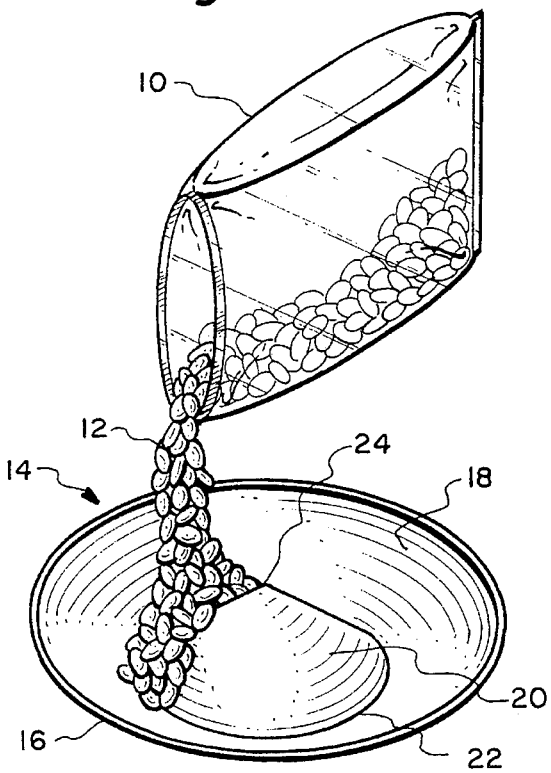
FIG. 6 is an isometric view depicting utilizing of the first embodiment collapsible container of the present invention as a fully expanded, center section inverted serving bowl for the contents of the foodstuff bag shown in FIG. 1.

The first embodiment of collapsible container 14 is constructed of a thin sheet material such as paper. The container 14 can be locatable in an expanded position defining a chamber 18. Chamber 18 is defined by body 16. The body 16 has a diameter defined as $D_1$ with a typical diameter being approximately fifteen inches. When in the expanded configuration, a center section 20 is deflectable within the chamber 18. This deflection is permitted by means of a score line 22 located at the periphery of the center section 20. The apex 24 of the center section 20 is on the longitudinal center axis of the chamber 18. The deflection of the center section 20 is accomplished manually by merely pressing in an upward direction depicted by arrow 28 the center section 20 when the collapsible container 14 is in the partially expanded position shown in FIG. 3. When this center section 20 has been deflected defining a convex cone shape, a certain amount of rigidity is produced to the body 16 which holds the body 16 in the expanded position thereby permitting the chamber 18 to be used to contain the foodstuff 12 as is shown in FIG. 6. The body 16 when located in the expanded position with center inverted assumes a concave cone shape with a base configuration as is clearly shown in FIG. 6 of the drawing.

Figure 2:
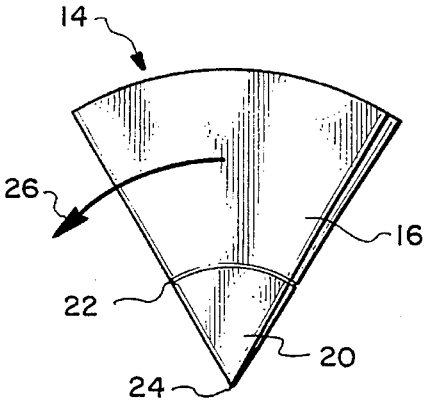
FIG. 2 is an exterior view of the first embodiment collapsible container of the present invention having been removed from the foodstuff bag.
Figure 3:
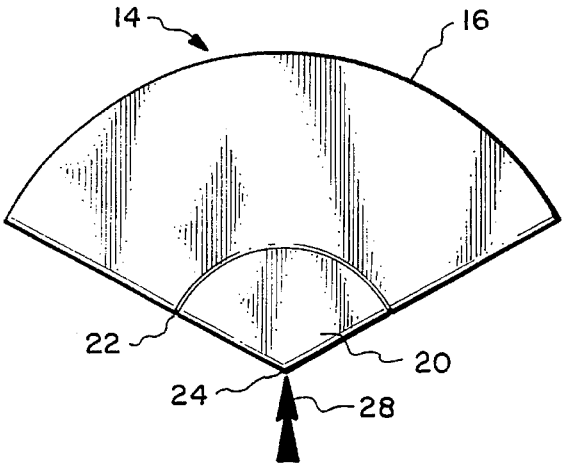
FIG. 3 is the side elevational view of the first embodiment collapsed container of the present invention showing the collapsible container in an intermediate expanded configuration.

When the first embodiment of collapsible container 14 is initially removed from the bag 10, it is in the totally collapsed position as is shown in FIG. 2. The container 14 is moved from the totally collapsed position (depicted by arrow 26) to an intermediate expanded position as is shown in FIG. 3. In both FIGS. 2 and 3, the collapsible container 14 is flat with FIG. 2 being about one-half the size of the collapsible container 14 shown in FIG. 3. The flat container 14 of FIG. 3 is to be manually expanded to the expanded position shown in FIGS. 4–6. The user then exerts upward pressure in the direction of arrow 28 against the score-lined center section 20 which will cause the center section 20 to deflect within the chamber 18 as is clearly shown in FIGS. 4, 5 and 6 of the drawing, forming a base upon which the container will rest.

It is to be understood that upon consuming of the foodstuff 12 within the container 18 or redepositing an unused portion of the foodstuff 12 back into the bag 10, that the collapsible container 14 can be refolded back to its collapsed state as shown in FIG. 2 and redeposited in the product bag 10.

Figure 4:
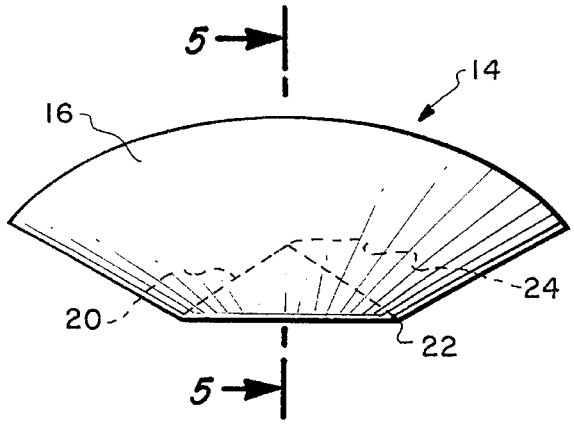
FIG. 4 is a side elevational view of the first embodiment collapsible container when in the expanded configuration with the center portion inverted.
Figure 5:
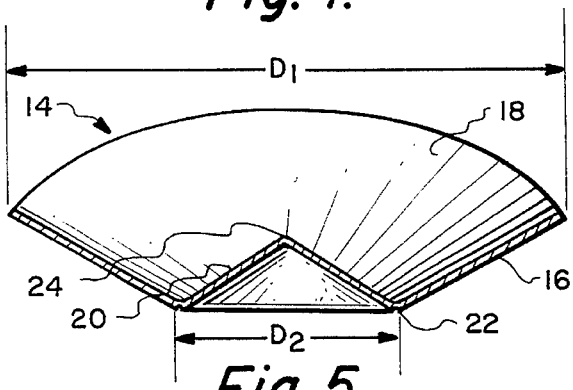
FIG. 5 is a cross-sectional view taken along line 5—5 of FIG. 4.
Figure 7:
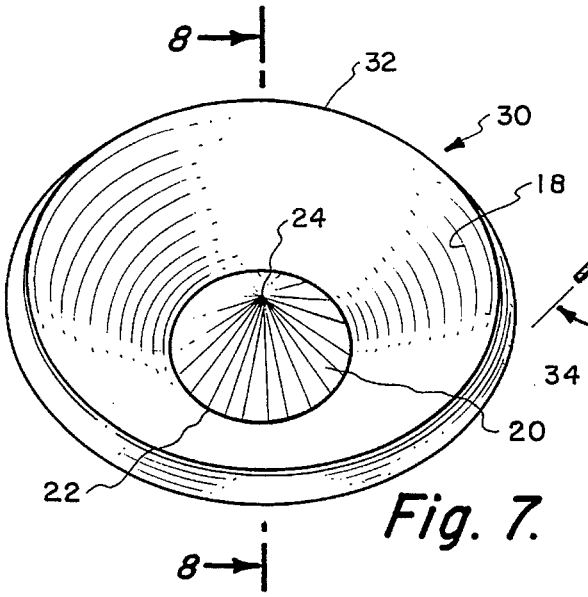
FIG. 7 is an isometric view of a modified form of the first embodiment of the collapsible container of this invention showing the collapsible container with the center section inverted in the ready-to-use configuration.
Figure 8:
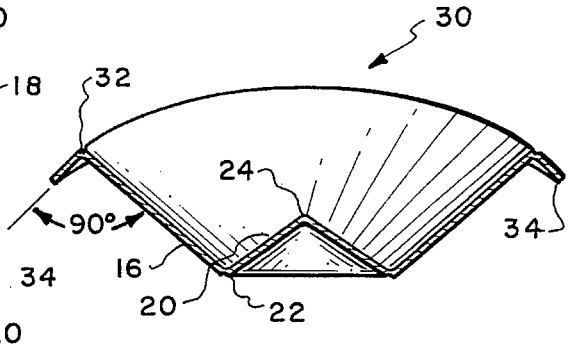
FIG. 8 is a cross-sectional view taken along line 8—8 of FIG. 7.

Referring particularly to FIGS. 7 and 8 of the drawing there is shown a modified form 30 of the collapsible container of this invention. The modified form 30 shown in FIGS. 7 and 8 is basically similar to the collapsible container 14 with like numerals being utilized to refer to like parts. The only difference within the modified embodiment of FIGS. 7 and 8 as compared to FIGS. 4, 5 and 6 is that the peripheral edge 32 is defined by a score line with there being attached at the peripheral edge 32 a lip 34. The lip 34 is to be deflected relative to the sidewall 16 to an approximate ninety degree outward position when the collapsible container is in the expanded position as shown in FIGS. 7 and 8. This deflected lip will provide an additional amount of rigidity to the modified form 30 when in the expanded position tending to keep the container in its established expanded position when serving of the dry small particle foodstuffs 12.

Figure 9:
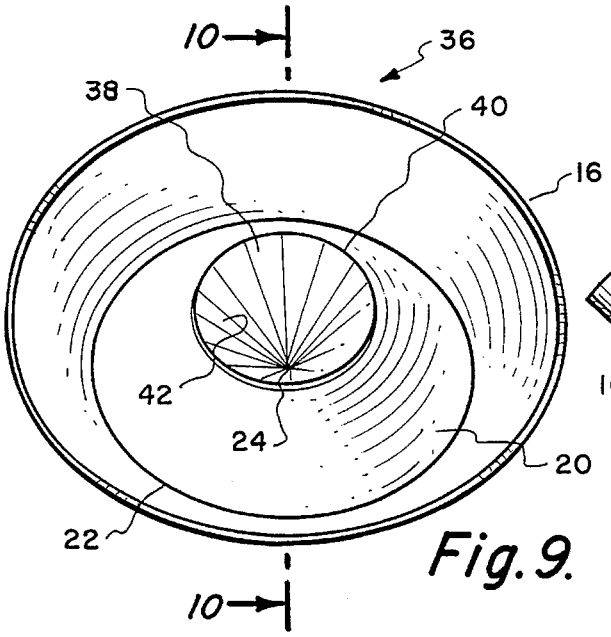
FIG. 9 is an isometric view of the second embodiment of the collapsible container of the present invention showing the collapsible container with a doubly inverted center section in the ready-to-use position.
Figure 10:
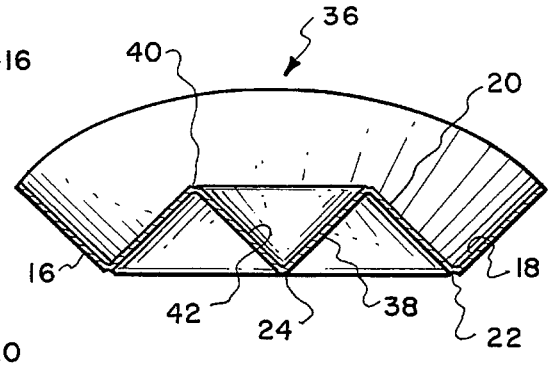
FIG. 10 is a cross-sectional view taken along line 10—10 of FIG. 9.
Figure 11:
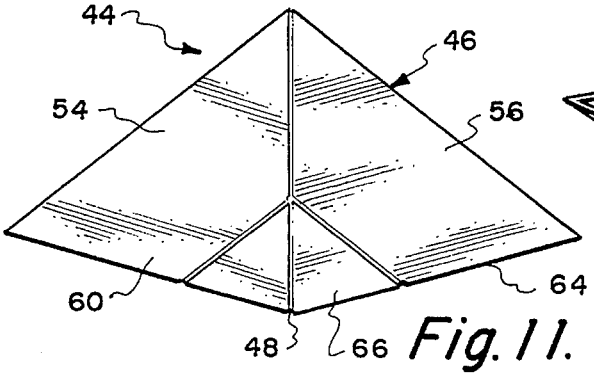
FIG. 11 is a side elevational view of a third embodiment of the collapsible container of the present invention showing the collapsible container in the collapsed and partially unfolded configuration.
Figure 12:
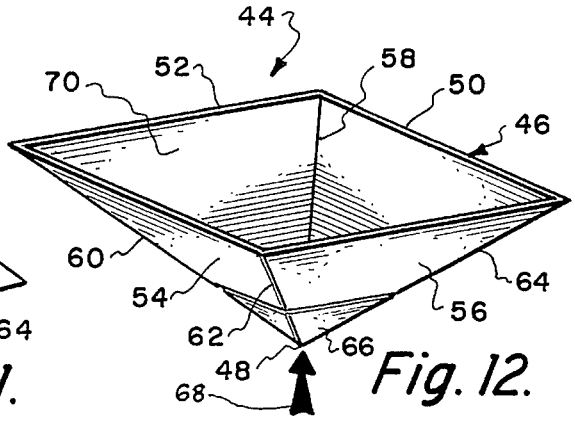
FIG. 12 is an isometric view of the third embodiment of the collapsible container of the present invention depicting a portion of the center section of the collapsible center to be moved in an inward direction which will place the collapsible container in a ready-to-use configuration.
Figure 13:
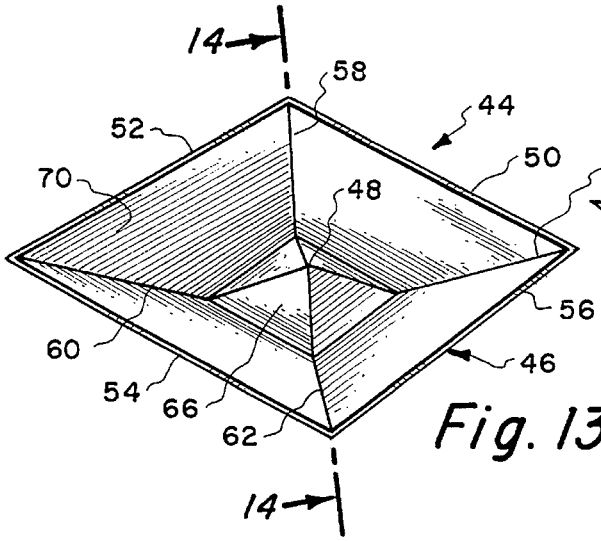
FIG. 13 is an isometric view of a third embodiment of the collapsible container of this invention showing the collapsible container in the ready-to-use configuration with an inverted center section.
Figure 14:
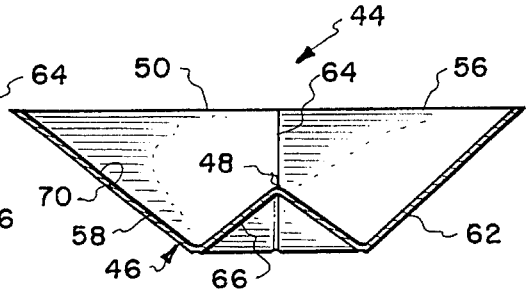
FIG. 14 is a cross-sectional view taken along line 14— 14 of FIG. 13.

Referring particularly to FIGS. 9 and 10, there is shown a second embodiment 36 of the collapsible container of this invention. Again like numerals have been used to refer to like parts when comparing the second embodiment 36 to the collapsible container 14.

The only difference of the second embodiment 36 is that the center section 20 includes an inner section 38 which is centrally located relative to the center section 20. The apex 24 is within this inner section 38. The inner section 38 is defined by a score line 40 within the center section 20. The center section 20 is still cone-shaped and basically will now be formed into the shape of a truncated cone. The inner section 38 is to be deflected about the score line 40 to assume a downwardly directed reverse cone-shaped configuration. The dry small particle foodstuff 12 is to be placed in the area defined by chamber 18 which is located between the center section 20 and the sidewall 16. This area comprises an annular configuration. A dip that is to be used in conjunction with the dry particle foodstuffs, such as a chip dip, sauce, dressing or the like, be placed within the chamber 42 defined by the inner section 38.

Referring particularly to FIGS. 7–14 of the drawings, there is shown a third embodiment 44 of the collapsible container of this invention which is again basically similar to the first embodiment 14 with the exception that the container 44 is of a basic polygonal shape resembling a pyramid as opposed to being cone shaped for the first embodiment 14. The third embodiment 44 is constructed of a sheet material sidewall 46 which terminates at a centrally located apex 48. The sidewall 46 is composed of four side panels 50, 52, 54 and 56 which are all of the same size. Separating the side panels 50 and 52 is a score line 58. Separating the side panels 52 and 54 is a score line 60. Separating the panels 54 and 56 is a score line 62. Separating the panels 56 and 50 is a score line 64. The fourth embodiment 44 can be folded to a flat configuration on score line 60 and 64 or by folding flat on score lines 58 and 62.

Incorporated in conjunction with the fourth embodiment 44 is a center section 66. Included within this center section 66 are extensions of each of the score lines 58, 60, 62 and 64 that terminate at the apex 48. The fourth embodiment 44 is opened to the position shown in FIG. 12 by application of manual pressure in the direction of arrow 68 which will result in the center section 66 being deflected upwardly to within the confines of the bowl container 70 formed by the enclosing area of the side panels 50, 52, 54 and 56. The deflection of the center section 66 into container 70 provides sufficient rigidity as a base to maintain the fourth embodiment 44 in the established open position so it can be used as a bowl in the same manner as embodiment 14.

Figure 15:
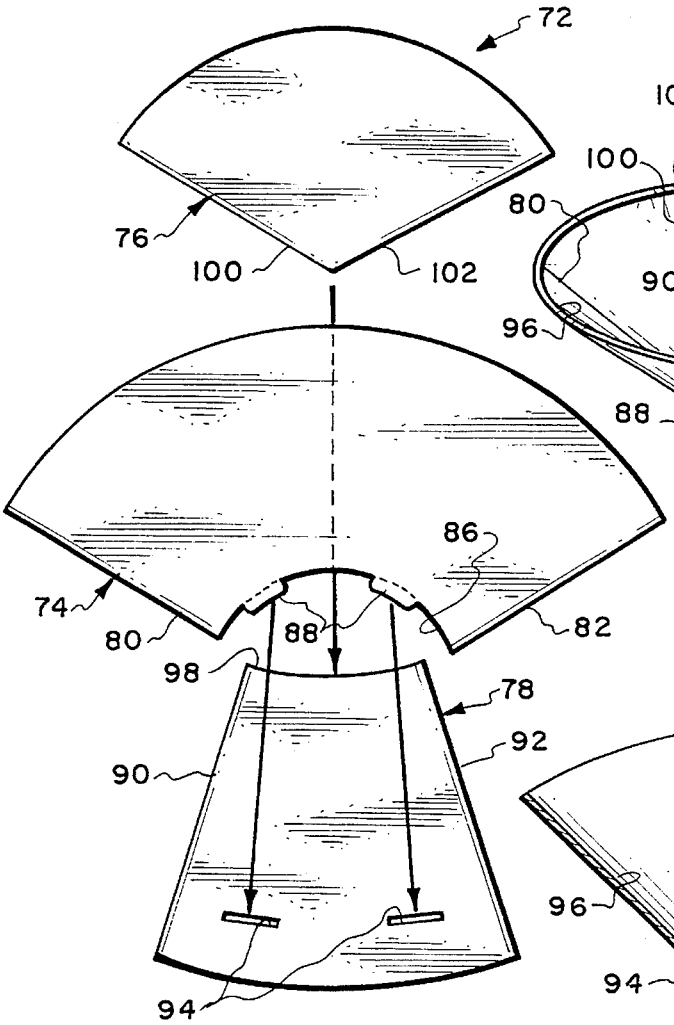
FIG. 15 is an exploded view of the different parts embodied within a fourth embodiment of the collapsible container of the present invention showing the parts in the collapsed state.
Figure 16:
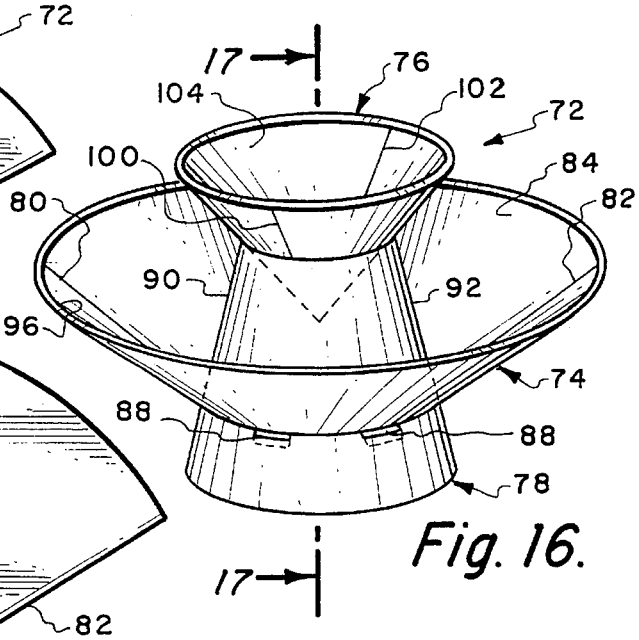
FIG. 16 is an isometric view showing the fourth embodiment of the collapsible container of this invention with dual container a ready-to-use configuration.
Figure 17:
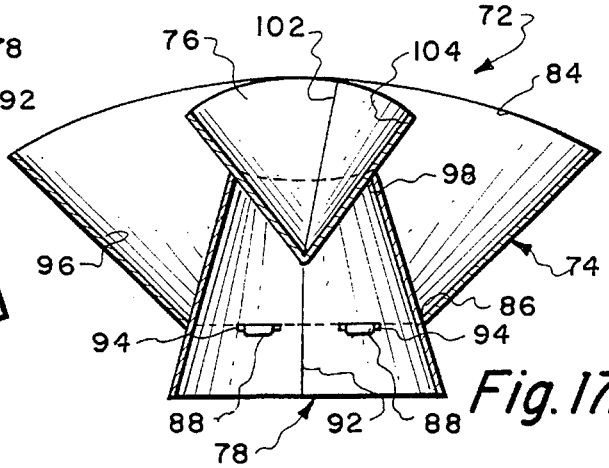
FIG. 17 is a cross-sectional view taken along line 17—17 of FIG. 16.

Referring particularly to FIGS. 15–17 of the drawings, there is shown the fifth embodiment 72 of this invention. The fifth embodiment 72 is actually constructed of three different pieces which will be termed a center part 74, a small container part 76, and an inner part 78. All three parts are to be constructed of sheet material with generally a paper being preferred. The center part 74, when in the expanded position, is basically in the shape of a truncated cone. The center part 74 includes score lines 80 and 82 which permit the folding of the center part 74 to the flat configuration. When in the expanded configuration, the center part 74 includes an enlarged upper opening 84 and a lower opening 86. The lower opening 86 is substantially smaller in size than the upper opening 84. Associated with the lower opening 86 are some locking tabs 88 which generally are four in number.

The sheet material inner part 78 is capable of being folded flat by means of score lines 90 and 92. When the inner part 78 is in the expanded configuration, the smaller diametered upper end of the inner part 78 can be inserted within the opening 86 until the locking tabs 88 engage with locking tab openings 94 formed in the inner part 78. This securely connects together the center part 74 and the inner part 78 forming a bowl chamber 96 within which is to be located a quantity of the dry particle foodstuff such as potato chips and the like.

The upper smaller diametered opening 98 of the inner part 78 is to provide a resting place for a cone-shaped small container 76. The cone shaped small container 76 has a pair of score lines 100 and 102. The score lines 100 and 102 permit the small container 76 to be folded flat as is shown in FIG. 15. Small container 76 can be expanded to what is shown in FIGS. 16 and 17 which will then permit the internal chamber 104 of the small container 76 to be utilized to support a dip or other similar type of substance to be used in conjunction with potato chips or other similar types of dry small particle foodstuffs. It is also considered to be within the scope of this invention that any one of the embodiments of this invention could be utilized with vegetables, fruit, a suitable dip, sauce or other like food products.

What is claimed is:

1. A collapsible container comprising:

a thin sheet material body, said body being locatable in a totally collapsed position, said totally collapsed position being essentially flat, said body being unfolded to an intermediate expanded position which is also flat, the size of said body in said totally collapsed position being approximately one-half the size of said body in said intermediate expanded position, said body being movable from said intermediate expanded position to an expanded position, said expanded position locates said body in a first cone shape forming a chamber adapted to contain a quantity of dry small particles of a foodstuff; and a main center section formed within said body, said main center section having a peripheral edge, said main center section being substantially smaller in size than said chamber, said main center section being deflectable into said chamber when said body is in said expanded position forming a second cone shape, said second cone shape being oriented in an opposite direction from said first cone shape and forming a base upon which said container can rest.

2. The collapsible container as defined in claim 1 wherein:

there being secondary center section formed within said main center section, said secondary center section being centrally located within said main center section, said secondary center section being deflected into said main center section when said body is in said expanded position forming a third cone shape, said third cone shape being oriented in an opposite direction from said second cone shape, said secondary center section forming a small container adapted to contain a dip foodstuff.

* * * * *